United States Patent [19]

Hurkett

[11] 4,231,126

[45] Nov. 4, 1980

[54] WATER BED WAVE GENERATOR

[76] Inventor: Earl Hurkett, 1201 W. 92nd #309, Denver, Colo. 80221

[21] Appl. No.: 4,685

[22] Filed: Jan. 19, 1979

[51] Int. Cl.[3] ..... A47C 27/08; A61H 1/00

[52] U.S. Cl. ..... 5/451; 5/108; 5/503; 5/508; 128/33; 128/64

[58] Field of Search ..... 5/451, 452, 107, 108, 5/109, 508, 509, 503; 128/33, 64; 405/79; 248/674, 295 R

[56] References Cited

U.S. PATENT DOCUMENTS

| | | | |
|---|---|---|---|
| 3,277,887 | 10/1966 | Thomas | 5/503 |
| 3,529,311 | 9/1970 | Crawford | 5/109 |
| 3,709,372 | 1/1973 | Alexander | 5/503 |
| 3,872,526 | 3/1975 | Betts | 5/109 |
| 4,141,096 | 2/1979 | Hale et al. | 5/108 |

*Primary Examiner*—Roy D. Frazier
*Assistant Examiner*—Alexander Grosz
*Attorney, Agent, or Firm*—Richard D. Law

[57] ABSTRACT

A pad mounted for resting on the top surface of a water bed reciprocates vertically to displace water forming waves in the water of the water bed, for relaxing a user. The speed, amplitude and time of operation of the pad is variable to the desires of the user.

8 Claims, 7 Drawing Figures

WATER BED WAVE GENERATOR

This invention relates to devices for making waves in the water of a water bed and their attachments to the frames of the water beds.

Water bed users, after a period of adjustment to the flotation support of water, enjoy the movement of the water in the water bed. Many water bed users relax in the movement and, therefore, roll or move to make waves in the water. This is not satisfactory as it requires muscle action to move one's body, disrupting the relaxing of the muscles. Vibrating means have been suggested in the prior art, but this produces a completely different effect than waves. The vibration does not displace very much water, so the bed recliner's body is not moved but merely vibrated. The major effect desired is the actual riding of waves which, is a progressive rise and fall of one side or end of a person to the other. Further, the desired amplitude of the waves in the bed will change with the moods of the user, as well as the length of time the waves are desired. Usually the waves are desired as one first reposes, prior to falling to sleep, since the relaxing achieved tends to incite sleep.

OBJECTS OF THE INVENTION

Included among the objects and advantages of the invention, is to provide a wave generator for a water bed.

Another object of the invention is to provide a reciprocable pad for a water bed to generate variable amplitude and frequency waves.

Still another object of the invention is to provide a mechanical wave generator for a water bed which variably displaces water to form waves in the water of a water bed, Yet another object of the invention is to provide a reciprocable pad for producing waves in a water bed which pad is adjustable as to height and frequency and the amplitude of motion.

These and other objects and advantages of the invention may be ascertained by reference to the following description and illustration.

GENERAL DESCRIPTION OF THE DRAWINGS

SPECIFIC DESCRIPTION OF THE DRAWINGS

Figure 1:
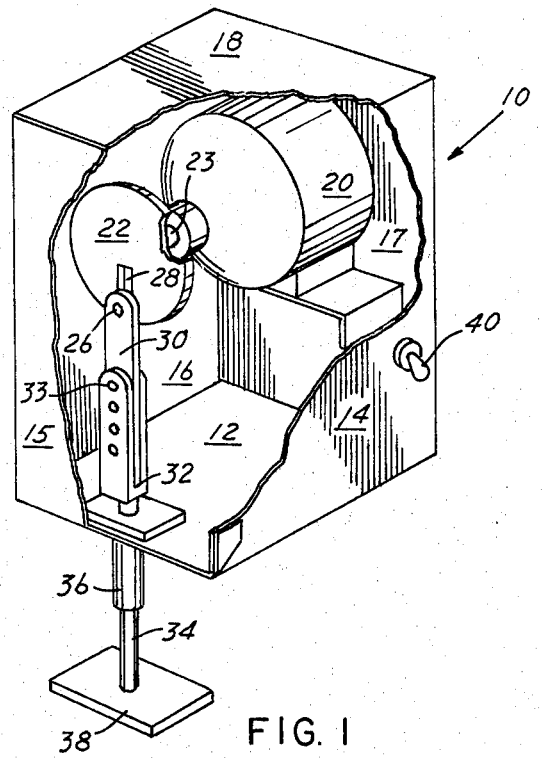
FIG. 1 is a cut away perspective view of a water bed wave generator according to the invention.

The device of FIG. 1 illustrates a variable eccentric mounting for a reciprocating arm, providing reciprocable motion of a wave generator pad from an electric motor. Other mechanisms are available for producing reciprocating motion of such a pad, for example cam and follower, solenoid actuated reciprocable arm, eccentric and connecting links, hydraulic, etc.

The specific device of FIG. 1 includes a housing, shown in full by numeral 10, which is a box shaped housing having a bottom 12 side walls 14, 15, 16, and 17, and a top 18. An electric motor 20 includes a variable eccentric wheel 22 mounted on motor shaft 23. Preferably, the motor is a variable speed motor arranged for common household 115 v alternating current. A crank arm 26 variably mounted in a radial slot 28, in the wheel 22, provides a variable length reciprocable motion of link 30 which is pivotally mounted on the crank arm 26. The link 30 is pivotally mounted in a yoke 32 by a pivot pin 33. The yoke is mounted on reciprocable rod 34 at its upper end, and rod 34 reciprocates in a guide tube 36. A wave generator pad 38 is mounted on the lower end of rod 34. This pad is preferably covered with sufficient padding to mask any corners or sharp elements which might puncture the flexible sheet or film of the water bed. Obviously, the pad may be completely devoid of sharp corners by rounding, or an oval or round pad may be used. For a simple hook up, an off-on switch 40, of the single throw toggle type may be used. The housing may be manufactured of a material which supports the motor and reciprocating parts, such as sheet metal, reinforced plastic, wood, etc.

Figure 2:
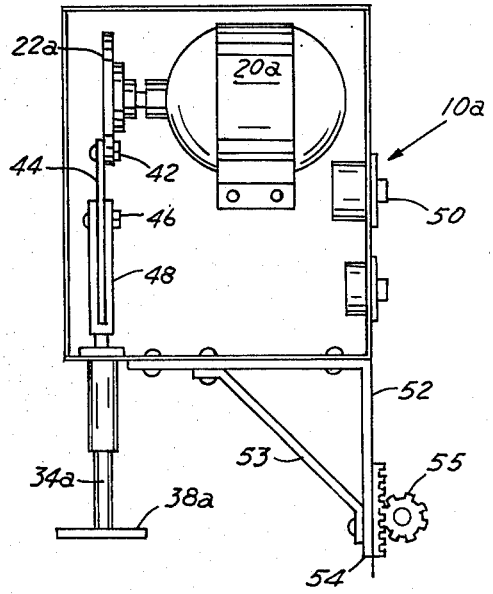
FIG. 2 is a side elevational view of a wave generator according to the invention with one side of the housing removed.

The modified unit of FIG. 2 includes a housing **10*a* having an internal motor 20*a* and an eccentric wheel 22*a*, secured by a fastener 42 to a reciprocating link 44 which is pivotally mounted by pivot pin 46 to a multiple position, elongated yoke 48. This provides a height adjustment for the pad 38*a* mounted on reciprocating arm 34*a*. The yoke 48 has a series of holes to permit the link 44 to be moved to several positions, adjusting the length of the linkage from pivot 42 to the pad 38*a*. The motor 20*a* is connected to a reostat 50, or other controller, to control the speed of rotation of the motor 20*a*. The housing is mounted on an angle support 52 with a brace 53. The support is mounted on a rack 54 intermeshed with a pinion 55** for adjusting the height of the housing on the bed frame. The rack may reciprocably telescope in a simple tubular guide mounted on a bed frame (not shown), and the pinion mounted on the guide permits height adjustment.

Figure 3:
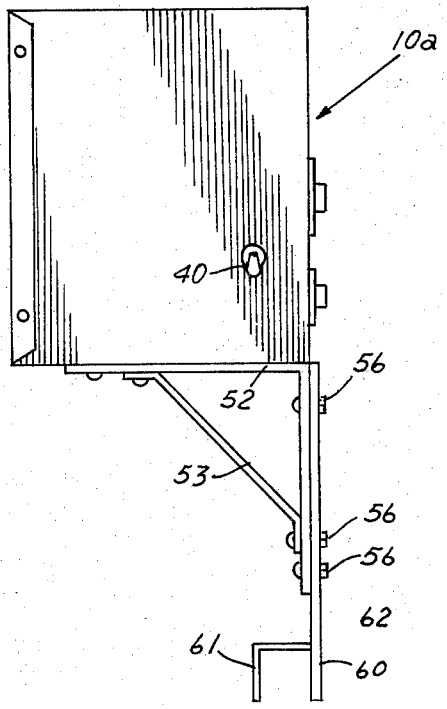
FIG. 3 is a side elevational view of the housing, and one form of support therefore, of a wave generator.

A modified mounting for the wave generator housing is shown in FIG. 3, wherein the housing **10*a* is mounted on the angle support 52 with the brace 53. The support is adjustably secured by bolt-nut sets 56 passing through bores in the support 52 and through a set of mating bores 62 in an upright plate or bar 60, which is a series of holes through which the bolts may pass. A bed frame hook 61 may be secured to the plate 60, and this hook may be fastened to the bed frame to support the plate upright. This arrangement provides a manual height adjustment for the housing 10*a***.

Figure 4:
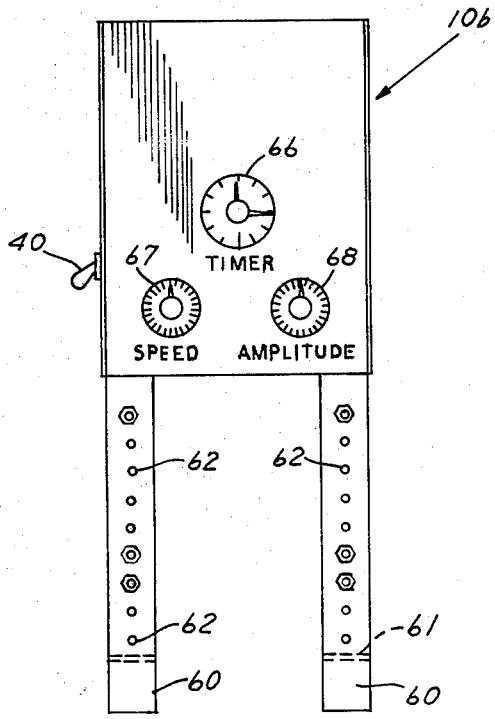
FIG. 4 is a rear view of a modified form of housing for a wave generator, illustrating controls for the generator.

A modification of the housing is shown in FIG. 4, which incorporates into housing **10*b*. A timer clock 66 for controlling the length of time energy is supplied to the motor drive. Such timer clocks and control of motor is well known. A reostat or other motor speed controller 67 may be provided to control the rotative speed of the motor and thereby the reciprocation of the pad. Such speed control means are commonly used on variable speed motors. An amplitude control 68 may, also, be provided for controlling the amplitude of the pad, as by changing the position of the pivot pin of the eccentric wheel. Such variable devices are known. In this modification, a pair of bars 60 support the angle supports 52**.

Figure 5:
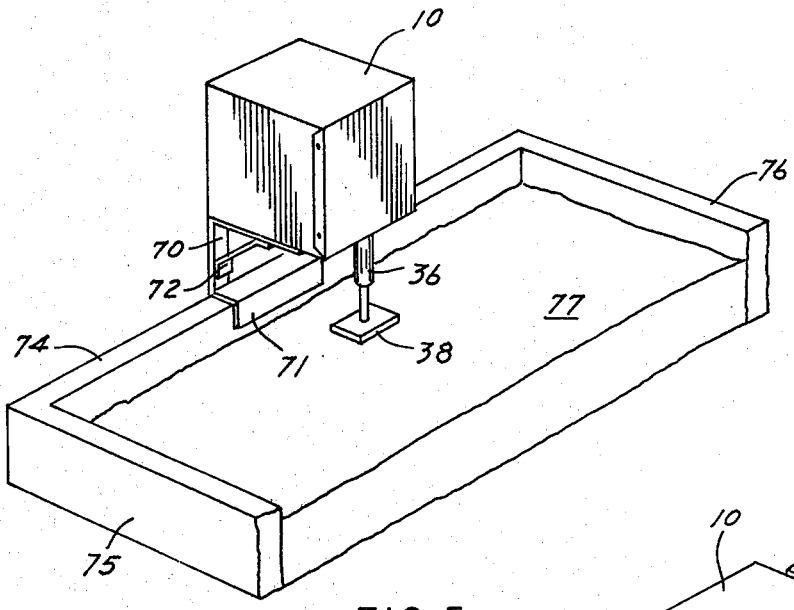
FIG. 5 is a partial perspective of one form of wave generator attached to a frame of a water bed.

The modification of FIG. 5 illustrates a housing 10 mounted on uprights 70, each attached to a bed frame hook 71 which extends between the two uprights. A further brace 72 secured to the two uprights may be used to support the unit. The hook seats over a bed frame end 74, which is attached to side rails 75 and 76. The height of the unit is adjusted to where the pad 38 is resting on water bed top 77.

Figure 6:
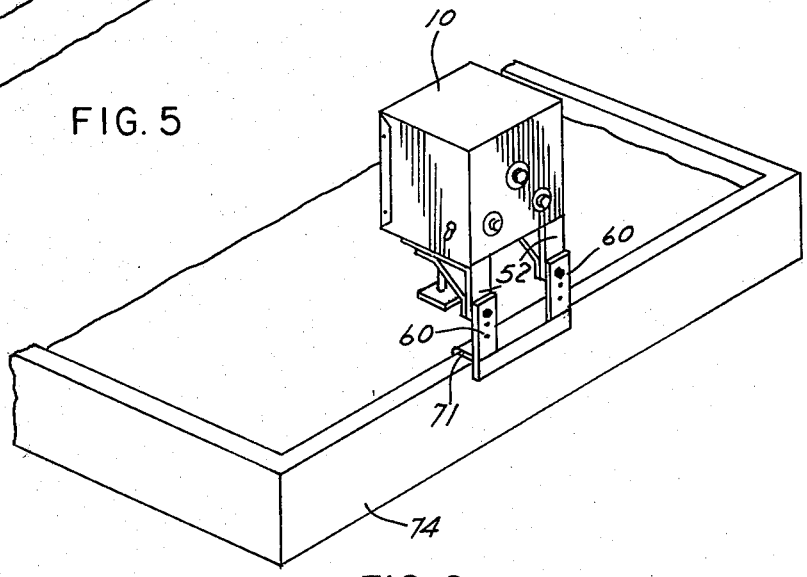
FIG. 6 is a partial perspective view of a modified mounting for a wave generator.

In the modification of FIG. 6, the housing 10 is mounted on supports 52 are secured to upright bars 60 for a variable height adjustment. The bed frame rail hook 71 supports the bars 60 in an upright position. Bolt and nut sets are used to vary the height of the housing.

Figure 7:
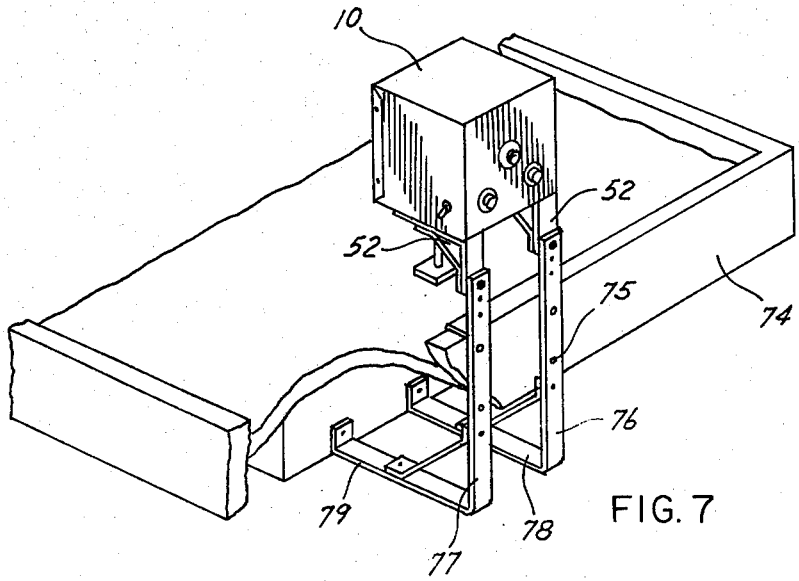
FIG. 7 is a partial perspective view of a further modified mounting for a wave generator.

For some types of frames of water beds, a frame which extends under the frame is necessary. In the modification of FIG. 7, the housing 10 mounted on angle supports 52 are adjustably mounted on uprights 76 and 77, which include laterals 78 and 79 respectively. These laterals, with turned up inner ends may be fastened by screws (for wooden frames), bolts (for metal frames) or the like. Bolt and nut sets provide means for the variable attachment of the housing to the uprights.

The wave generator is easily made versatile for attachment, speed and amplitude. The adjustments may be manual or mechanically or electrically actuated for ease of adjustment while lying down. For example, the pinion of FIG. 2 may be motor driven, whereby a simple on-off toggle switch may be used by a bed occupant to adjust the height. It is to be noted that as the effective length of the pad reciprocable arm is varied, the height of the housing should be varied so as to maintain the pad in contact with the water bed as the top of its stroke.

What is claimed is:

1. A wave generator for water beds, comprising:

(a) housing means;

(b) mounting means to mount the housing to the frame of a water bed, said mounting means adapted to vary the height of the housing means relative to the top surface of a water bed;

(c) reciprocable pad means mounted for contact with the top surface of a water bed and arranged to press into the water bed to displace a substantial quantity of water in the water bed;

(d) reciprocating actuating means in said housing;

(e) connecting means between said reciprocating actuating means and said reciprocable pad means for pressing said pad means into the water bed; and, (f) means for periodically operating said reciprocating actuating means for periodically reciprocating said pad means, thereby periodically forming waves in the water of said water bed.

2. A wave generator for water beds according to claim 1, wherein said reciprocating actuating means includes electric motor mounted eccentric wheel and said connecting means is secured to said pad means and said eccentric wheel.

3. A wave generator for water beds according to claim 2, wherein said eccentric wheel has a variable eccentric connection to said connecting means.

4. A wave generator for water beds according to claim 2, wherein said electric motor is variable.

5. A wave generator for water beds according to claim 2, being further characterized by timer means in said electric motor circuit for timing the duration of operation.

6. A wave generator for water beds according to claim 2, wherein said connecting means is variable as to length.

7. A wave generator for water beds according to claim 2, wherein said mounting means includes a rack and pinion.

8. A wave generator for water beds according to claim 1, wherein said mounting means includes perforated bar means and bolt and nut sets for variably securing said housing on said perforated bar means.

* * * * *